United States Patent [19]

Kemble

[11] 4,407,037

[45] Oct. 4, 1983

[54] MOLD CLEANING APPARATUS

[76] Inventor: Mern S. Kemble, 130 Entrance Dr., New Kensington, Pa. 15068

[21] Appl. No.: 296,063

[22] Filed: Aug. 25, 1981

[51] Int. Cl.[3] ..... B08B 9/08

[52] U.S. Cl. ..... 15/93 R; 15/104.1 C; 29/81 J

[58] Field of Search ..... 15/89, 91, 92, 93 R, 15/93 C, 104.09, 104.1 R, 104.1 C, 104.14, 104.0 C, 236 R, 236 C, 246.5, 4; 241/194; 29/81 J

[56] References Cited

U.S. PATENT DOCUMENTS

| | | | |
|---|---|---|---|
| 2,886,332 | 5/1959 | Elwick | 241/194 |
| 3,082,452 | 3/1963 | Heine et al. | 15/93 R |
| 3,176,995 | 4/1965 | Ferris | 241/194 X |
| 4,210,976 | 7/1980 | Apelt et al. | 15/104.1 C |

FOREIGN PATENT DOCUMENTS

| | | | |
|---|---|---|---|
| 233092 | 3/1961 | Australia | 15/89 |
| 497102 | 5/1930 | Fed. Rep. of Germany | 15/93 R |

*Primary Examiner*—Edward L. Roberts
*Attorney, Agent, or Firm*—Jon M. Lewis

[57] ABSTRACT

Mold cleaning apparatus including a cutter assembly for removing undesired material from a mold, a boom pivotally supporting the cutter assembly and the cutter assembly including a shaft member, a number of radially projecting cutter members fixedly secured to the shaft for rotation therewith, the cutter members having a cutter blade mounted at the outer extremity thereof and resilient connecting links interposed between the cutter blades and the shaft. The boom may be mounted for both axial rotation and rotation about an axis oriented generally perpendicularly with respect to the boom and telescoping movement. The boom may be mounted on a vehicle.

21 Claims, 5 Drawing Figures

MOLD CLEANING APPARATUS

BACKGROUND OF THE INVENTION

1. Field of the Invention

This invention relates generally to cutter assemblies and, more specifically, such apparatus which is adapted to function as an ingot mold cleaner.

2. Description of the Prior Art

In connection with the molding of metal ingots in various types of ingot molds, a problem has been encountered as a result of impurities in the mold and the building up of layers of the impurities to an intolerable thickness. Such action tends to contribute to defects in ingots molded in the particular mold. As subsequent heats are poured, the impurities may tend to marbleize or go into the ingot being formed thereby creating quality control problems in respect of the ingot, as well as semifabricated and fabricated products to be made from the same. Ingots which are defective as a result of such impurity contamination generally have to be relegated to use in lower priced items where the impurities and resultant defects can be tolerated.

With respect to molds which are only partially filled, such as those which would be encountered at the end of a pour, the amount of impurities that tend to scald or splash the sides of the mold contributes further to undesired depositing of impurities on the mold interior surfaces.

It has been known to attempt various means of cleaning the ingot mold interior surfaces. For example, it has been known to employ air under high pressure, flailing chains or brushes and other mechanical means. One of the problems with such approaches is that they tend to burnish the inside of the ingot molds rather than cleaning off the encrusted material.

There remains, therefore, a substantial need for an efficient means of effectively removing undesired impurities from the interior of an ingot mold so as to reduce the likelihood that these impurities will contribute to a defective ingot.

SUMMARY OF THE INVENTION

The present invention has produced a solution to the above-described problem by employing a unique cutter head assembly wherein a shaft member has a plurality of generally radially projecting cutter members fixedly secured thereto for rotation therewith. The cutter members have a cutter blade mounted at the outer extremity thereof and a resilient connecting link interposed between the cutter blade and the shaft. Mounting means may be secured to the shaft so as to permit attachment of a plurality of cutter members to the shaft at a single axial location on the shaft. The resilient connecting links may preferably be composed of rubber and have sufficient rigidity to, under the influence of the rubber as well as centrifugal force maintain the cutting member in substantially straight shape during normal cutting operations and yet permit deformation of the cutter member when the cutting blade hits material which is not readily cut through a single contact.

The cutter head may advantageously be pivotally secured to a boom member which may, if desired, be vehicle mounted. The boom member may be adapted for axial rotation so as to position the cutter member in the desired location. Further, means may be provided for rotating the boom a generally horizontal oriented about an axis generally perpendicular to the boom axis.

It is an object of the present invention to provide an ingot mold cleaner which will efficiently remove encrusted impurities from the interior surface of an ingot mold without damaging the mold.

It is a further object of the invention to provide such apparatus which is adapted to be vehicle mounted and controlled so as to permit precise positioning of the cutter head.

It is a further object of the present invention to provide a cutter head wherein individual cutter members which are radially disposed with respect to a shaft member contain resilient connecting means which are adapted to remain undeformed during normal cutting operations, but will resiliently deform when the cutter blade contacts material which is too hard to be cut in a single pass.

It is a further object of the present invention to employ such resilient connecting links so as to dampen the transmission of vibration and shock from the cutter blade to the shaft.

These and other objects of the invention will be more fully understood from the following description of the invention on reference to the illustrations appended hereto.

Figure 1:
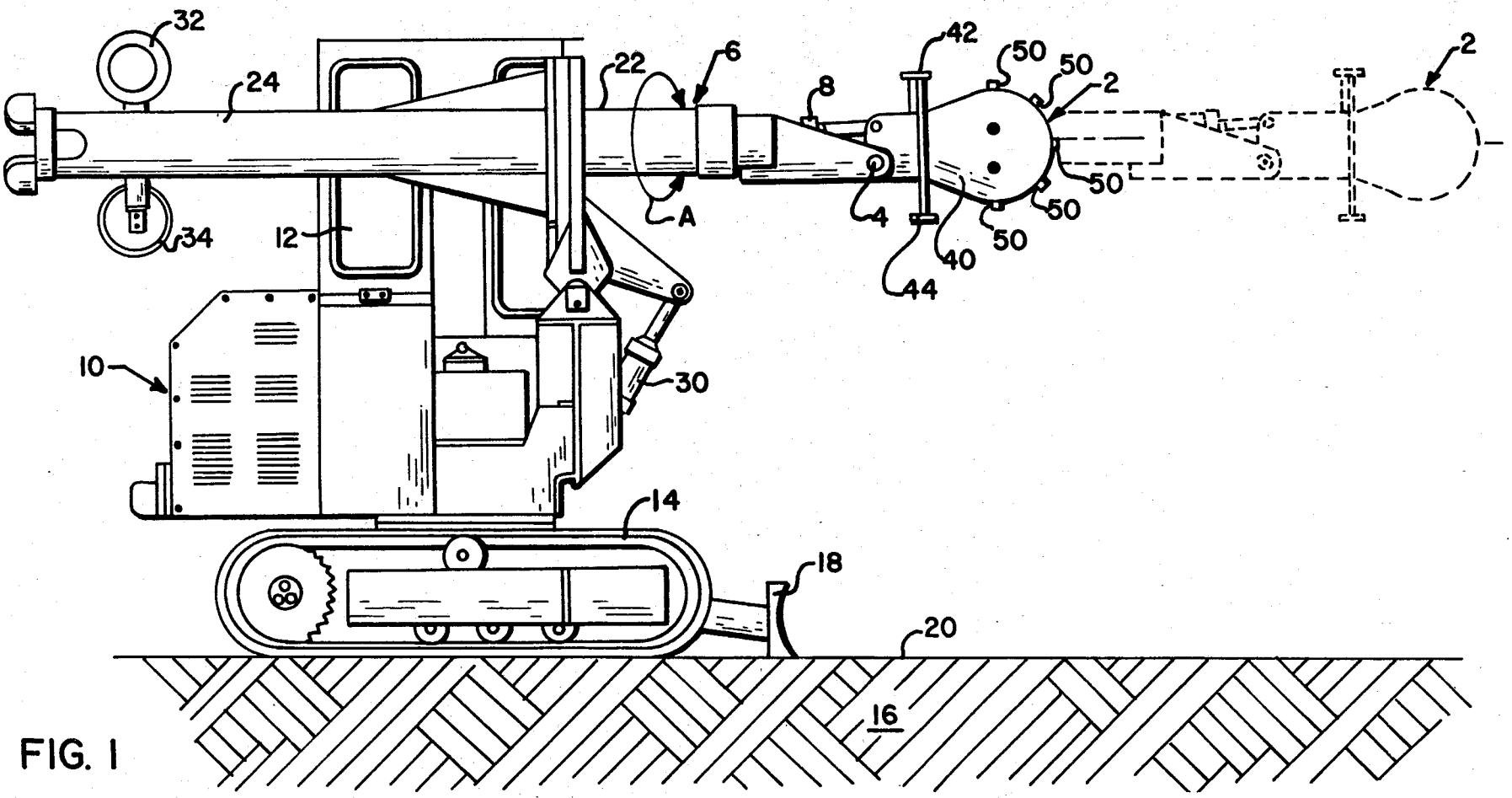
FIG. 1 is a partially schematic elevational view of a vehicle-mounted form of ingot mold cleaner of the present invention.

Referring now in greater detail to FIG. 1, there is shown a cutter head assembly 2 which is attached by pivot 4 to boom 6 and is adapted for pivoting movement with respect to boom 6 under the influence of hydraulic or pneumatic cylinder 8 about pivot 4. In the form illustrated the boom 6 is mounted on a vehicle 10 which has an operator compartment 12 and is supported on power driven traction means 14 which engage the ground 16. It is noted that the vehicle has a blade 18 disposed generally forwardly of power driven traction means 14. The blade 18 is adapted to serve as a means for leveling the ground surface 20 where desired for more stable positioning of the apparatus.

If desired, the boom 6 may consist of a telescoping boom so as to permit expansion of the boom to position the cutter assembly forwardly such as shown in phantom in FIG. 1. This may readily be accomplished by permitting section 22 to be of smaller diameter than section 24 and having suitable means such as hydraulic means to permit relative movement between boom portions 22, 24.

Further, if desired, means may be provided to establish axial rotation of the boom 6 in directions indicated generally by the arrow A up to approximately 360°. This degree of rotation permits appropriate positioning of the cutter head 2 without risking undesired damage to the hydraulic or pneumatic lines. Such rotation may be effected by any conventional means and may involve rotation of the forward portion 22 of boom 6 as by a suitable hydraulic motor with or without interposed speed reduction gearing (not shown).

Further, by means of cylinder 30 the boom 6 may be caused to rotate in a direction generally vertically about an axis generally perpendicular to its own axis. This also serves to provide for precise positioning of the cutter head. Suitable takeup spools 32, 34 for the hydraulic or pneumatic lines (not shown) are provided on the rear portion of the boom in the form illustrated.

Referring still to FIG. 1, a further feature of the invention will now be considered. The housing 40 for the cutter has secured thereto an upper scraper bar 42 and a lower scraper bar 44 which are fixedly secured to the housing 40. Prior to initiating operation of the cutter head rotating blades, it will frequently be advantageous to scrape the interior of the mold using one or both of the scraper bars or blades 42, 44.

Figure 2:
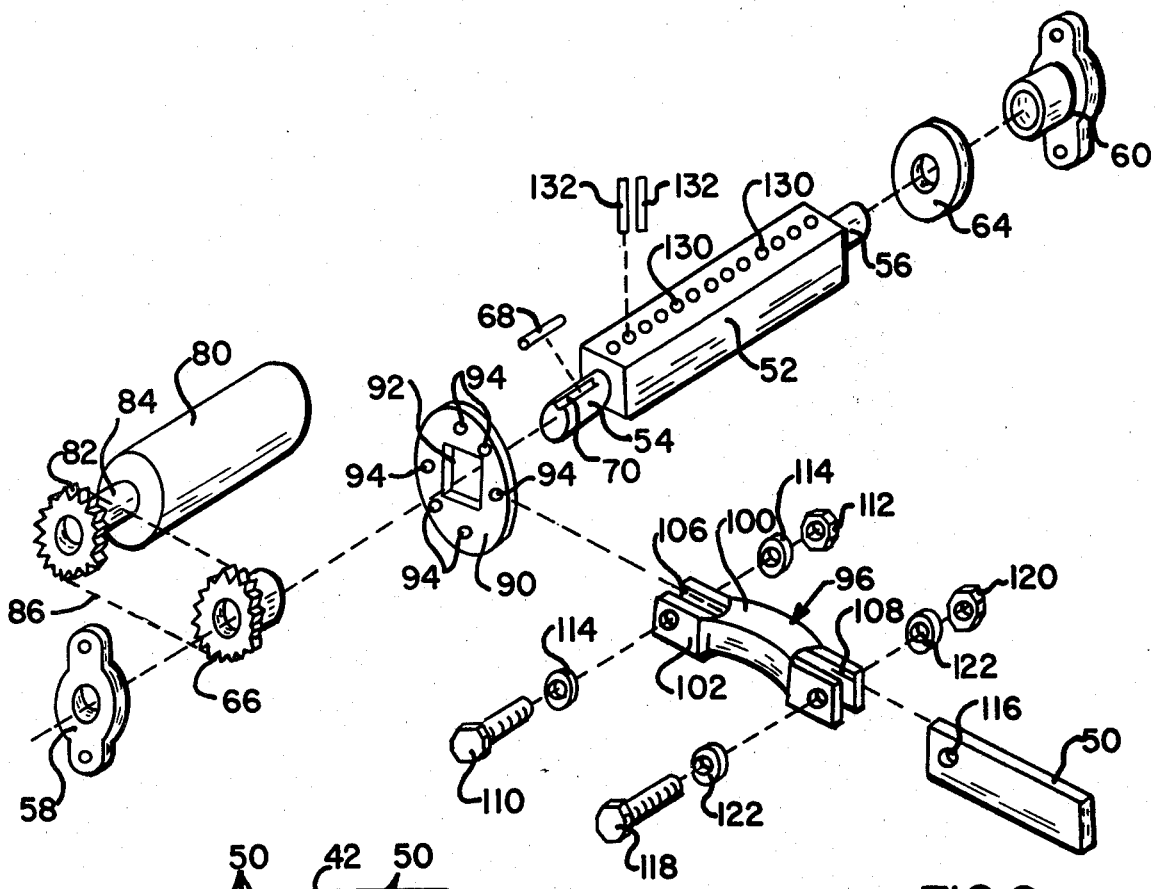
FIG. 2 is an exploded view showing a portion of the cutter head of the present invention.
Figure 3:
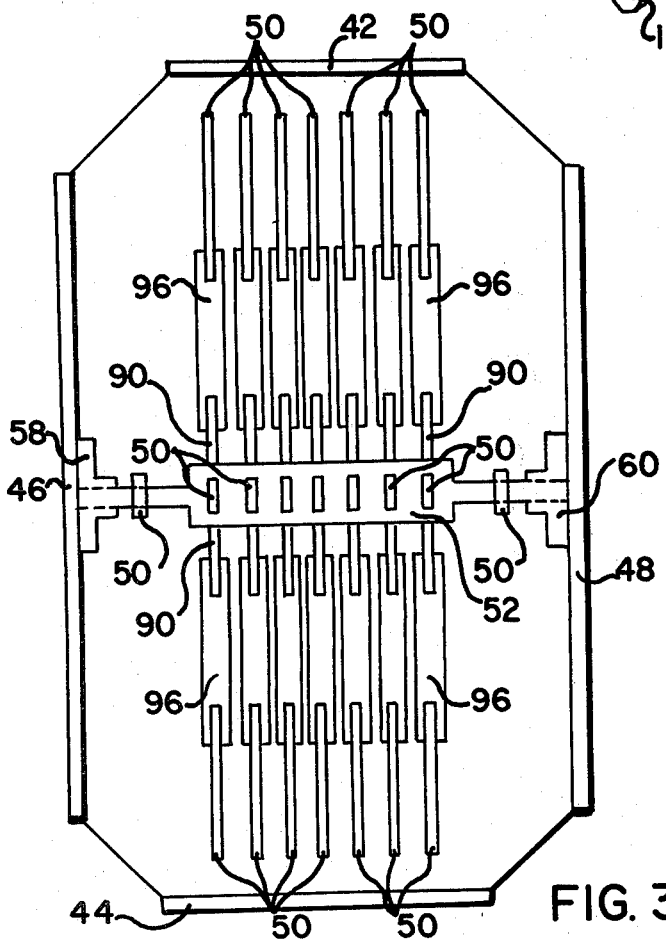
FIG. 3 is a front elevational view of the cutter head.

Referring more specifically to FIGS. 1, 2 and 3, the details of a preferred form of cutter head will now be considered. The cutter head 2 has a housing which includes sidewalls 46, 48 leaving an open region for radially outward projection of the cutter blades 50. As is shown in FIG. 2 the shaft 52 is of generally rectangular cross sectional configuration with cylindrical end portions 54, 56 which are, respectively, adapted to be journaled within bearings 58, 60 which are secured to the sidewalls 46, 48, respectively. A washer member 64 is provided on cylindrical shaft portion 56 and a drive sprocket 66 is fixedly secured to cylindrical portion 54 by means of key 68 which is received in keyway 70. A suitable drive motor, such as hydraulic motor 80 which may advantageously be secured to an inner portion of the housing as by mounting on plates 46 or 48 drives sprocket 82 through shaft 84 and through chain 86 produces responsive rotary movement of driven sprocket 66 to rotate shaft 52 about its longitudinal axis.

Referring still to FIG. 2 there is shown a mounting member 90 which in the form shown is a disc having a central opening 92 which is complementary in shape with the rectangular portion of shaft 52 and of slightly larger size so as to be adapted to receive the shaft and rotate therewith. The mounting member has a plurality of smaller openings 94, which in the form shown consist of six such openings, each of which is adapted to secure a cutter member to the shaft 52. The cutter member consists of a resilient connecting link 96 and a radially outwardly disposed cutter blade 50.

Figure 4:
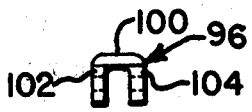
FIG. 4 is an end view of a form of connecting link employed in the present invention.
Figure 5:
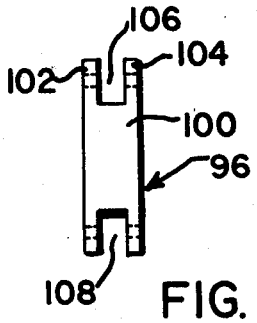
FIG. 5 is a top plan view of the connecting link shown in FIG. 4.

In the form shown, the resilient link 96, which may preferably be made of rubber, is of generally downwardly open channel shape. As is shown in FIGS. 4 and 5, the link 96 has an upper body portion 100 sidewalls 102, 104 and a pair of outwardly open recesses 106, 108. The sidewalls 102, 104, have a pair of alligned fastener-receiving openings each of within the regions of recesses 106, 108. In establishing a cutter member assembly, the openings in recess 106 are aligned with an opening 94 on mounting member 90 and the two members 90, 96 are secured to each other by means of suitable fasteners such as bolt 110, nut 112 and associated washers 114. Similarly, the openings in the sidewalls 102, 104 associated with recess 108 are aligned with opening 116 in cutter blade 50 and are secured in this position by means of bolt 118, nut 120 and associated washers 122.

In the form shown, mounting member 90 is adapted to have secured to it six such cutter member assemblies, but other numbers could be employed, if desired. It is noted that the shaft has a series of openings 130 axially spaced from each other and are adapted to cooperate with a series of roll pins 132 in securing a mounting member 90 in the desired axial position on the shaft 52. Referring to FIG. 3, while the roll pins are not shown in this view, it will be appreciated that a pair of roll pins 132 may be positioned on opposite sides of each of the mounting members 90 shown in this view.

It will be appreciated that as the shaft 52 is subjected to axial rotation under the influence of the motor 80 the radially oriented cutter arms will be subjected to orbital movement with the resilient connecting links serving to maintain the cutter member in substantially straight orientation. In this fashion, material desired to be removed from the mold interior will be severed as a result of the action of the cutting blades 50. It will be appreciated, that to the extent desired, centrifugal force may be relied upon to contribute to this generally straight orientation of the cutter members as the shaft 52 is rotated. It is preferred that the material out of which the connecting link 96 is composed be of sufficient rigidity to maintain the generally straight contour of the cutter member during normal cutting operations but have sufficient resiliency that when the cutting member blade 50 contacts a material which is too hard to be cut in one pass, the resilient connecting link 96 will yield so as to permit the blade 50 to move around the object or material which has not been cut on that pass. The resiliency will then cause the cutter member to resume its substantially straight configuration. This resiliency also dampens vibrations and shock which might otherwise be transmitted from the cutter blades 50 to shaft 52.

In a preferred embodiment, the resilient connecting link 96 will have a greater length than the cutter blades 50.

In operation of the equipment, it will generally be preferred to have it mounted on a vehicle of the type described above. After positioning the vehicle adjacent the mold through telescoping action, the cutter head 2 may be moved to a position closely adjacent to the material desired to be removed from the ingot mold interior. By rotating the cutter head with respect to the boom, one of the scraper blades 42, 44 may be caused to effect initial removal of certain material. Subsequently rotation of shaft 52 is initiated and through a combination of movement of the vehicle, telescoping action of the boom, axial rotation of the boom and rotation of the cutter head with respect to the boom, desired positioning of the cutter head may be effected for initiation of cutting through rotation of shaft 52. Such rotation is then initiated and the cutter head moved during the cutting operation in order to achieve the desired removal of material.

It will be appreciated, therefore, that the present invention provides an effective means of automated removal of undesired materials from the interior of an ingot mold. This is readily accomplished through either initial scraping action followed by powered cutter member action or solely by cutter member action. Positioning of the cutter member and scraper members may be effected automatically in order to provide for efficient cutting action. Further, as a result of resilient dampening links in the cutter members, effective cutting action is obtained during normal operation and yielding is provided for when unduly hard material is encountered. Further, the resilient links contribute to dampening of undesired vibration and shock loads which otherwise would be transmitted through the cutter member to shaft 52.

Whereas particular embodiments of the invention have been described above for purposes of illustration, it will be appreciated by those skilled in the art that numerous variations of the details may be made without departing from the invention as described in the appended claims.

I claim:

1. A mold cleaning apparatus comprising:

cutter assembly means for removing undesired material from said mold;

boom means pivotally supporting said cutter assembly;

said cutter assembly means including a shaft member, a plurality of generally radially projecting cutter members fixedly secured to said shaft, said cutter members having a cutter blade mounted at the outer extremity thereof;

each of said cutter members having a resilient connecting link interposed between said cutter blade and said shaft;

power means for effecting axial rotation of said shaft;

mounting means securing said cutter members to said shaft;

said resilient connecting links having one end portion secured to a said cutter blade and another end portion secured to said mounting means;

said mounting means having a series of mounting members secured to said shaft member at axially spaced positions; and each said mounting member connecting a plurality of said cutter members to said shaft.

2. The mold cleaning apparatus of claim 1 including the radially outermost portions of said connecting links having recesses for receiving a portion of said cutter blades, first fastener means securing said cutter blade to said connecting link, said mounting members having a central opening through which said shaft passes and radially outwardly projecting connecting link-engaging portions, the radially innermost portion of said connecting link having a recess receiving a portion of said mounting member, and second fastener means securing said connecting length to said mounting member.

3. The mold cleaning apparatus of claim 1 including said connecting links being composed of rubber.

4. The mold cleaning apparatus of claim 1 including said resilient connecting links composed of a material which will dampen vibrations generated by contact between said cutter blades and the material being cut.

5. The mold cleaning apparatus of claim 1 including cylinder means for pivoting said cutter assembly with respect to said boom means.

6. The mold cleaning apparatus of claim 5 including said boom means being mounted for axial rotation and means for effecting said axial rotation.

7. The mold cleaning apparatus of claim 6 including support means for supporting said boom means, and second means for rotating said boom means about a generally horizontal axis oriented generally perpendicular to said boom means axis.

8. The mold cleaning apparatus of claim 7 including said support means including vehicle means.

9. The mold cleaning apparatus of claim 8 including said vehicle means including power driven traction means and blade means secured generally forwardly of said traction means.

10. The mold cleaning apparatus of claim 7 including said boom means having telescoping means.

11. The mold cleaning apparatus of claim 4 including said resilient connecting links being composed of a material which will dampen vibrations generated by contact between said cutter blades and the material being cut.

12. A cutter head assembly mounted on boom means comprising:

a shaft member, said shaft member installed perpendicular to the boom member, power means for effecting axial rotation of said shaft, a plurality of generally radially projecting cutter members fixedly secured to said shaft, said cutter members having a cutter blade mounted at the outer extremity thereof, mounting means securing said cutter members to said shaft, and each of said cutter members having a resilient connecting link interposed between said cutter blade and said shaft, said resilient connecting links having one end portion secured to said cutter blade and the other end portion secured to said mounting means.

13. The cutter head assembly of claim 12 including said mounting means including a series of mounting members which are secured to said shaft member to axially spaced positions.

14. The cutter head assembly of claim 13 including each said mounting member connecting a plurality of said cutter members to said shaft.

15. The cutter head assembly of claim 14 including the radially outermost portions of said connecting links having recesses receiving a portion of said cutter blades, and first fastener means securing said cutter blade to said connecting link.

16. The cutter head assembly of claim 15 including said mounting members having a central opening through which said shaft passes and radially outwardly projecting connecting link-engaging portions.

17. The cutter head assembly of clain 16 including the radially innermost portion of said connecting links having recesses receiving a portion of said connecting link-engaging portions, and second fastener means securing said connecting links to said mounting member.

18. The cutter head assembly of claim 12 including said connecting links being of generally channel-shaped configuration.

19. The cutter head assembly of claim 18 including said connecting links being of greater length than said cutter blades.

20. The cutter head assembly of claim 12 including said resilient connecting links composed of a material which will dampen vibrations generated by contact between said cutter blades and the material being cut.

21. The cutter head assembly of claim 12 including said resilient connecting links being sufficiently rigid to maintain substantial rigidity of said cutter member during cutting of material from the mold but sufficiently resilient so as to deform when said cutting blades contact a material too hard to be cut be said cutter blades.

* * * * *